US006050874A

United States Patent [19]

Ries

[11] Patent Number: 6,050,874

[45] Date of Patent: Apr. 18, 2000

[54] BALLOON COUPLING STRIP

[76] Inventor: Mary Kae Ries, 4212 San Felipe, #426, Houston, Tex. 77027

[21] Appl. No.: 08/806,499

[22] Filed: Feb. 27, 1997

Related U.S. Application Data

[63] Continuation of application No. 08/292,853, Aug. 19, 1994, abandoned.

[51] Int. Cl.[7] ..... A63H 27/10; B64B 1/54; B64B 1/58

[52] U.S. Cl. ..... 446/221; 446/220; 446/222

[58] Field of Search ..... 446/220, 222

[56] References Cited

U.S. PATENT DOCUMENTS

| | | | |
|---|---|---|---|
| 1,289,136 | 12/1918 | Elliott | 206/347 X |
| 1,627,505 | 5/1927 | Guymon | 40/214 |
| 2,684,776 | 7/1954 | Rosenstein | 206/346 |
| 3,366,999 | 2/1968 | Darby | 446/222 |
| 3,462,020 | 8/1969 | Hall | 211/73 X |
| 3,778,096 | 12/1973 | Smith | 294/87.2 |
| 3,962,757 | 6/1976 | Gedney | 24/30.5 S |
| 4,004,683 | 1/1977 | Pomeroy et al. | 206/347 X |
| 4,155,552 | 5/1979 | Jacobo et al. | 273/101 |
| 4,644,610 | 2/1987 | Fish | 24/30.5 S |
| 4,769,749 | 9/1988 | Felski | 362/250 |
| 5,004,633 | 4/1991 | Lovik | 244/31 X |

*Primary Examiner*—Kien T. Nguyen
*Assistant Examiner*—David A. Fleming
*Attorney, Agent, or Firm*—Conley, Rose & Tayon, P.C.; Mark L. Berrier

[57] ABSTRACT

A coupling strip for connecting a plurality of balloons in adjacent sequential position to one another in fascial and inexpensive manner consisting of an elongate flexible strip, made from plastic, cloth or other lightweight flexible material and in which the length thereof is determined by the number of sequential adjacent balloons one wishes to couple together for decorative or for any other purpose of notice and in which the width thereof is sufficient only to carry an aperture between the edges, the coupling strip consisting of a sequence of such apertures, spaced from one another substantially throughout the length of the coupling strip, for receiving the neck of a balloon. The apertures may be spaced at any desired distance from one another so as to facilitate insertion of a balloon neck in either a budding relation to an adjacent balloon or at any desired distance therefrom throughout the length of the coupling strip.

13 Claims, 1 Drawing Sheet

BALLOON COUPLING STRIP

This application is a continuation of applicatiom Ser. No. 08/292,853 filed Aug. 19, 1994 now abandoned.

DESCRIPTION OF THE PRIOR ART

Heretofore the use of balloons in the entertainment and decoration industry has been commonly known and the manner of their use is likewise known throughout the land. The balloons, which are commonly inflated with helium and provided in a multitude of colors, generally are arranged and displayed by tieing them together with a string or deploying them at the end of a stick or simply releasing them in the environment allowing them to float aimlessly and relentlessly to the ceiling or to the sky. The ability to arrange and control the position of one balloon in relation to an adjacent balloon or all of the balloons in an array of pre-determined configuration has not generally been accomplished in economical fashion heretofore. In fact, the most commonly known method for coupling one balloon to another or for affixing a plurality of balloons in an array has been through the use of mere manual string tieing, an exercise which is both time consuming, labor intensive, and hence marketedly uneconomical.

BACKGROUND OF THE INVENTION

The present invention endeavors to remedy all of the shortcomings characterizing the heretofore common and popular practice of using multi-colored inflated balloons for decorative purposes and other commonly understood uses. The use of strings, sticks, individual plastic clamps to restrict, tie down or otherwise couple one balloon to another has not only been economically impractical but has heretofore posed a threat of environmental contamination due to the unintentional escape frequently of hundreds of balloons from an auditorium or playing field or from the residue that is left when the balloons have been deflated after an event. The present invention resolves and precludes all of the disadvantages inherent in the use of commonly known balloons heretofore. The invention hereof resides in a balloon coupling strip made from an extended lightweight material rolled into a spool, easily transported, packaged, sold and put into use. The features and advantages of this invention are multi-fold and range from the simplicity of manufacture to its functional installation in practice, even by a child. The product requires no cooperating parts and is presented in a single component piece without clamps, clips, adhesive or any other element necessary for its use. Simplicity of manufacture, use and removal are its prominent features. These and numerous other features and advantages of the invention hereof will become readily apparent upon a reading of the detailed description, claims and drawings which appear hereafter.

DETAILED DESCRIPTION OF THE DRAWINGS

DETAILED DESCRIPTION

The present invention is directed to an extendible lightweight coupling strip which may be made from a fabric, polystyrene or other flexible material of pre-determined length and width which may be rolled into a spool. The dimensional characteristics of the coupling strip are such that it need be no wider than is necessary to carry the plurality of sequential apertures described hereafter. Generally, a width of approximately an inch to an inch and one-half is sufficient while a length ranging up to hundreds of feet, more or less, depending on how long or how short one may desire the balloon array. Both width and length may, however, be influenced by the chosen material. Polystyrene for example, or other useable plastics, have substantial tensile strength and therefore need not be very wide and can withstand substantially any projected length. In view of the fact that balloons, when filled with helium, do not exert any significant force on the coupling strip except when they are used in an outside environment and are there subjected to environmental winds. Even in such a circumstance, it is more likely that an individual balloon could tear loose from the edges of its respective restraining aperture as opposed to there resulting a tearing of the coupling strip itself.

Figure 1:
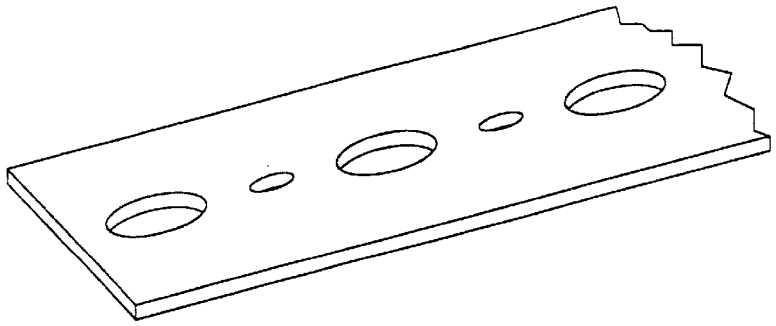
FIG. 1 is an isometric view illustrating a section of the balloon coupling strip of the invention.
Figure 2:
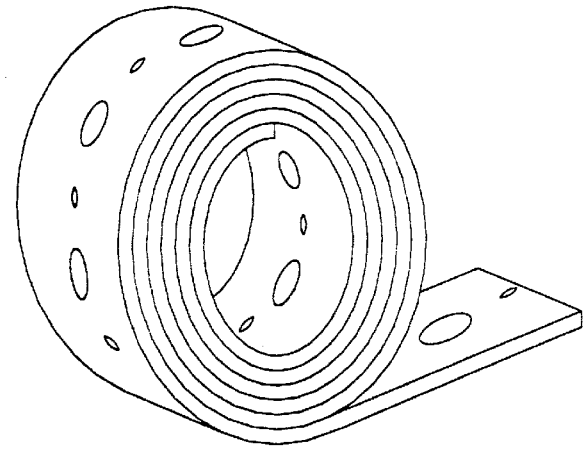
FIG. 2 is an isometric view of the balloon coupling strip of FIG. 1 but showing same rolled into a spool for purposes of sale, transportation and preceding use.
Figure 3:
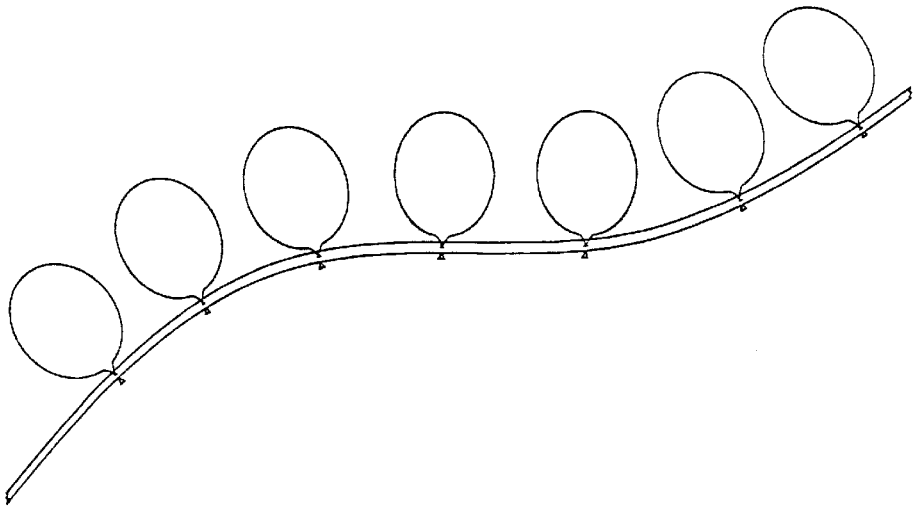
FIG. 3 illustrates actual use of the balloon coupling strip of the invention showing a plurality of balloons floating in a pre-arranged array in which each is deployed and organized in pre-determined distance with respect to the others by reason of the fixed distance apertures of the coupling strip.

The coupling strip is characterized by a plurality of apertures which are generally circular in shape and are placed approximate to the longitudinal center line of the strip. The apertures are spaced from one another at a distance of approximately two inches although this distance is determined entirely by how close or how far from one another each of the balloons are to be placed. In order to provide the ultimate user of the coupling strip with discretion as to the distance between adjacent balloons, the apertures are manufactured at distances of approximately two inches from each other, thereby providing the user with a wide range of selection in deciding the configuration of the balloon array. Diameter of the apertures may be of different sizes depending upon the size of the balloon neck and lip. Larger balloons have larger necks and lips and the gauge of the balloon itself may change. Thus it is possible to have two or more different sizes of diameters within the same coupling strip (see FIG. 2) wherein it is shown that a larger size diameter aperture is employed for larger balloons and intermittently and between the larger diameter apertures there resides a continual sequence of smaller diameter apertures for receiving balloons having smaller necks and lips. In either case the unused apertures, whether they be smaller apertures or larger apertures, are not readily visible to the eye as is the coupling strip itself since the balloon bodies, when inflated, obstruct vision of the strip. As here described, the apertures generally are circular and the shape is sufficient to accept the neck and lip of a balloon and to restrict escape of balloon from the aperture due to the rolled nature of balloon lips, particularly after the neck is knotted. It is practical however to conceive of the use of other forms of apertures, such as for example, a triangular aperture which allows for ready insertion of an extended neck and lip at the larger side thereof (the base of the triangular aperture) and which may more readily grip the neck and lip at the apex of the triangular configuration. In any event, the apertures present in the strip are found to readily retain the neck and lip of balloons and that the significant characteristic thereof is the size of the aperture in relation to the next size and lip of the balloon but that because all balloons are inherently extensible, and in the course of extending the neck and lip of a balloon, one finds that the thickness dimension thereof generally reduces, that relatively small apertures, in the range of one quarter of an inch (¼") in diameter, or less, will accept and retain practically all balloon sizes used in conventional celebrations, ceremonies and displays.

Therefore that which is claimed and desired to be secured by a United States Letters Patent is:

1. An improved arrangement of novelty balloons wherein said novelty balloons form a decorative display, the arrangement comprising:

a plurality of novelty balloons, each balloon having a neck;

an elongated strip having a plurality of apertures therethrough, wherein said elongated strip is flexible, lightweight, rollable into a spool, and sufficiently small to be transportable by an individual, each of the balloons being disposed with the neck thereof in one of the apertures, the neck of each balloon being secured within the aperture.

2. The means for securing balloons of claim 1 wherein the weight of the strip is less than the upward force exerted by the balloons secured therein when the balloons are filled with helium.

3. The means for securing balloons of claim 1 wherein the apertures comprise more than one series, the apertures of each series having a distinct size, each distinct size being suitable for holding a different size balloon.

4. The means for securing balloons of claim 1 wherein the strip is formed from fabric.

5. The means for securing balloons of claim 1 wherein the strip is formed from plastic.

6. The means for securing balloons of claim 5 wherein the plastic is polystyrene.

7. The means for securing balloons of claim 1 wherein the strip comprises a single piece means for holding the balloons in a substantially linear array.

8. The arrangement of novelty balloons of claim 1 wherein the strip has one or more points at which the strip is secured to a stationary anchor, the remainder of the strip being free to move about the anchored points.

9. The means for securing balloons of claim 1 wherein said elongated strip is configured to be installed by an individual.

10. A method of constructing an arrangement of novelty balloons wherein said novelty balloons form a decorative display, the method comprising the steps of:

Providing an elongated strip of lightweight, flexible, rollable material having a plurality of apertures therethrough wherein said elongated strip is sufficiently small to be transportable by an individual;

Providing a plurality of novelty balloons, each balloon having a neck which has a diameter smaller than the remainder of the balloon;

inserting the neck of each balloon through one of the apertures in the strip;

securing the neck of each balloon in the aperture;

extending the strip so that the balloons are spaced according to the apertures in the strip.

11. The method of claim 10 wherein the neck of each balloon has a lip and wherein each balloon is secured in the corresponding aperture by placing the lip against a side of the elongated strip opposite the balloon.

12. The method of claim 10 wherein the neck of each balloon has a knot and wherein each balloon is secured in the corresponding aperture by placing the knot against a side of the elongated strip opposite the balloon.

13. the method of claim 10 wherein providing the elongated strip comprises:

providing the elongated strip rolled into a spool; and unrolling the elongated strip from the spool prior to inserting the neck of each balloon through one of the apertures in the elongated strip.

* * * * *